United States Patent [19]

Karlsson

[11] 3,995,809

[45] Dec. 7, 1976

[54] ARRANGEMENT FOR AIR-CONDITIONING OF ONE OR MORE ROOMS

[75] Inventor: Tord Herlog Ingemar Karlsson, Norrahammar, Sweden

[73] Assignee: Aktiebolaget Svenska Flaktfabriken, Nacka, Sweden

[22] Filed: Jan. 21, 1975

[21] Appl. No.: 542,828

[30] Foreign Application Priority Data

Jan. 21, 1974 Sweden ..... 7400767

[52] U.S. Cl. ..... 237/2 B; 62/160; 62/324; 62/513

[51] Int. Cl.[2] ..... G05D 23/01

[58] Field of Search ..... 237/2 B; 62/324, 513, 62/81, 160, 238

[56] References Cited

UNITED STATES PATENTS

| | | | |
|---|---|---|---|
| 2,221,688 | 11/1940 | Gibson | 62/160 X |
| 2,241,060 | 5/1941 | Gibson | 237/2 B X |
| 2,769,314 | 11/1956 | Wheeler | 62/160 |
| 2,935,857 | 5/1960 | McFarlan | 62/159 |
| 3,103,793 | 9/1963 | Kyle et al. | 62/160 X |

*Primary Examiner*—William E. Wayner
*Assistant Examiner*—William E. Tapolcia, Jr.
*Attorney, Agent, or Firm*—Howson and Howson

[57] ABSTRACT

A heating system for a room comprising two heat pumps. A base heat pump is designed so that its evaporator never freezes up or that no frost layer forms during wintertime operation. An auxiliary heat pump is provided and is put into operation during times of extreme cold, whenever the capacity of the base heat pump is not enough to sufficiently heat the room. When the outside heat exchanger of the auxiliary heat pump freezes up, provision is made to reverse the operation of the auxiliary heat pump so the outside heat exchanger becomes the condenser. Thus, the outside heat exchanger is thawed.

7 Claims, 6 Drawing Figures

ARRANGEMENT FOR AIR-CONDITIONING OF ONE OR MORE ROOMS

Figure 1:
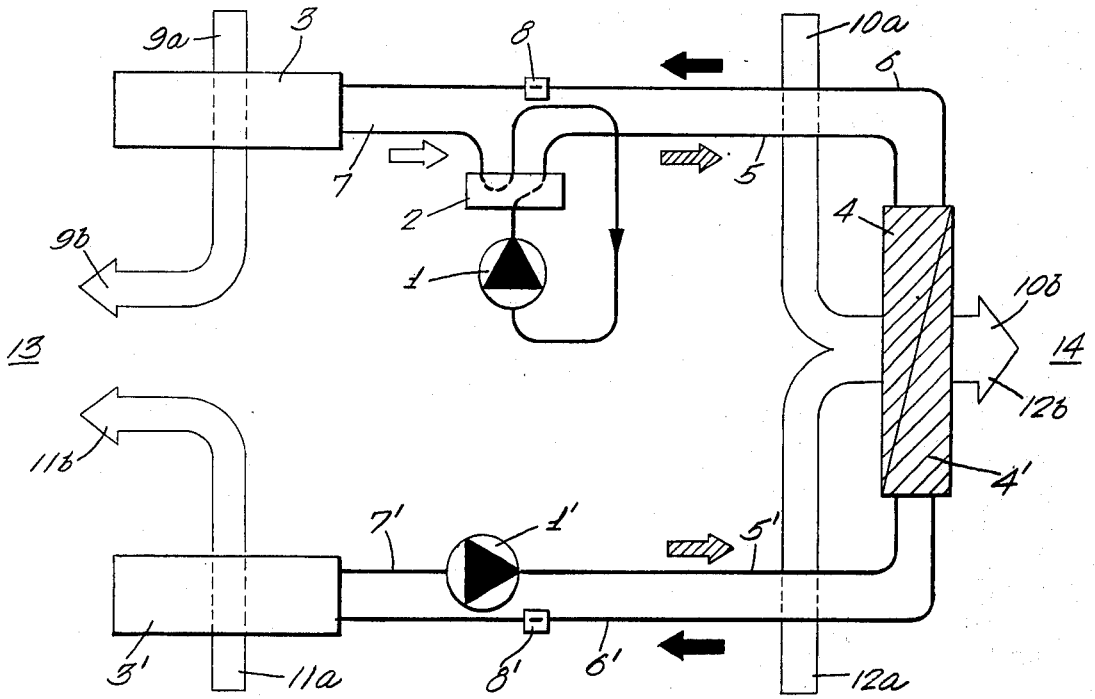

This invention relates to an arrangement for use in the airconditioning of a one or more rooms by utilization of heat pump.

In order to satisfy in a better way the increasingly higher requirements on efficiency within a large working range and on operation economy, the function of conventional air-conditioning units is now increasingly frequently accomplished with a heat pump process. The heat pump acts in this conjunction as a wintertime-heating system and as a summertime-cooling system, and it also reacts to such variations in climate during a season and a day which make it necessary to heat and, respectively, cool in order to provide a comfortable indoor climate. The interesting property of the heat pump in this conjunction is its capability to transfer more energy than is required fo input energy in carrying out the process. This principle is attractive but that heretofore the initial and maintenance costs much too often have been obstructive to the utilization on a broader scale of the heat pump as an integrated part in air-conditioning units. The present invention has as its object, in air-conditioning installations of the aforesaid kind, to render it possible to make the right use of the good properties of the heat pump and to avoid to the greatest possible extent its bad properties, and at the same time to protect the components comprised in such installations against such stresses as occur in cases of large working range and great load variations.

It is known that a large working range and great load variations for a heat pump imply the disadvantage of a high compression ratio of the compressor comprised in the heat pump, and that low evaporation temperature and high-pressure pipe temperatures, as well as defrosting and change between heating and cooling operation, result in rapid temperature changes and reversed coolant flow. It is also known that stepping down implies low gas velocities and discontinuity in operation, while starts made with a heat exchanger heavily cooled by outside air can result in coolant included in the oil. As a consequence of the aforesaid disadvantages, the compressor parts and the expansion and reversing valves, as well as the electric windings for the motors in the heat pump installations, will be subjected to additional stresses.

The essentially novel and characterizing features of the arrangement according to the invention are that two or more heat pumps —at least one heat pump hereinafter called the base heat pump and at least one heat pump hereinafter called the auxiliary heat pump and designed so as to operate intermittently and only at particularly low outside temperatures —are used, that the heat for the base heat pump is taken up and, alternatively, emitted by means of a heat exchanger mounted in a separate supply duct for outside air and operating as an evaporator and, respectively, condenser, and that the base heat pump is so dimensioned and designed that the pressure level in its heat receiving battery in the heating case is adjusted to such a lowest value, that frost formation on the cold surface of the battery is safely prevented, whereby the base heat pump is capable of operating continuously — i.e. without interruption for defrosting —and can be dimensioned with a capacity so high that the intermittent operation periods of the auxiliary heat pump can be limited to the climate periods in which the outside air has a temperature so low that its moisture content is low and, consequently, the frost coat caused thereby is insignificant.

An advantageous embodiment of the arrangement is characterized in that the heat emitting battery of the auxiliary heat pump mounted in the supply air flow of the room(s) is disposed where the air temperature is lowest, which provides a compression ratio favourable for the compressor process, with moderate gas temperatures and stresses on the material.

According to a characterizing feature of a preferred embodiment of the arrangement, the heat required for defrosting the auxiliary heat pump is taken from the condenser heat of the base heat pump in order to accelerate the defrosting so that the defrosting periods are scarcely perceptible in the room(s).

Figure 3:
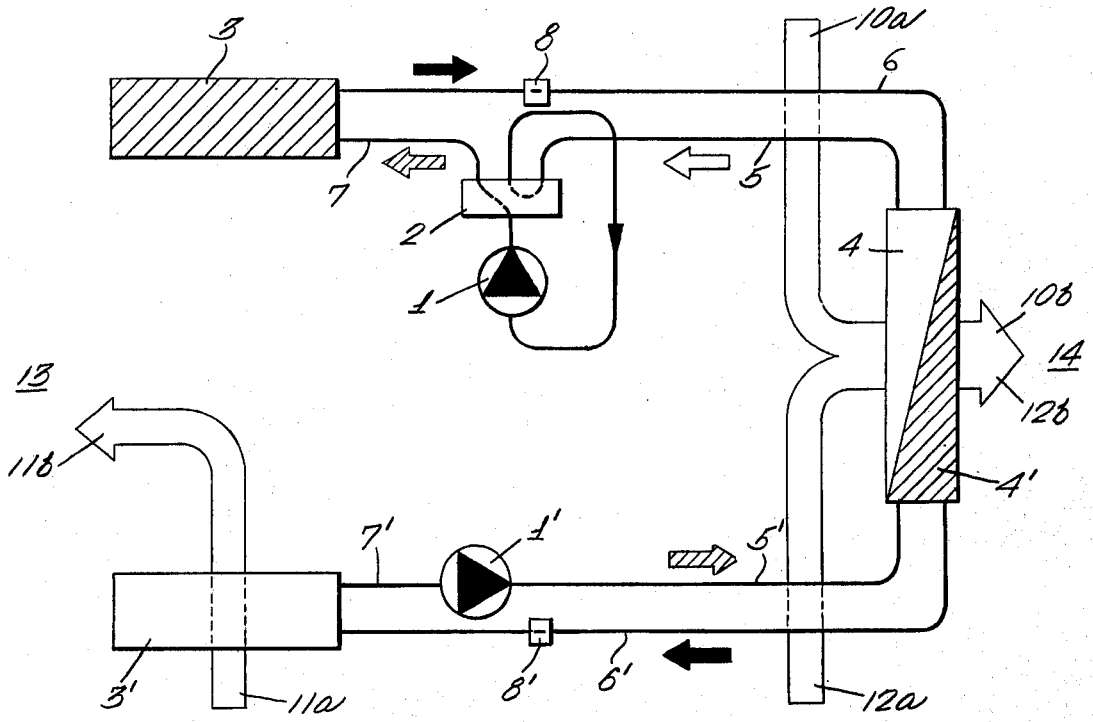
Figure 6:
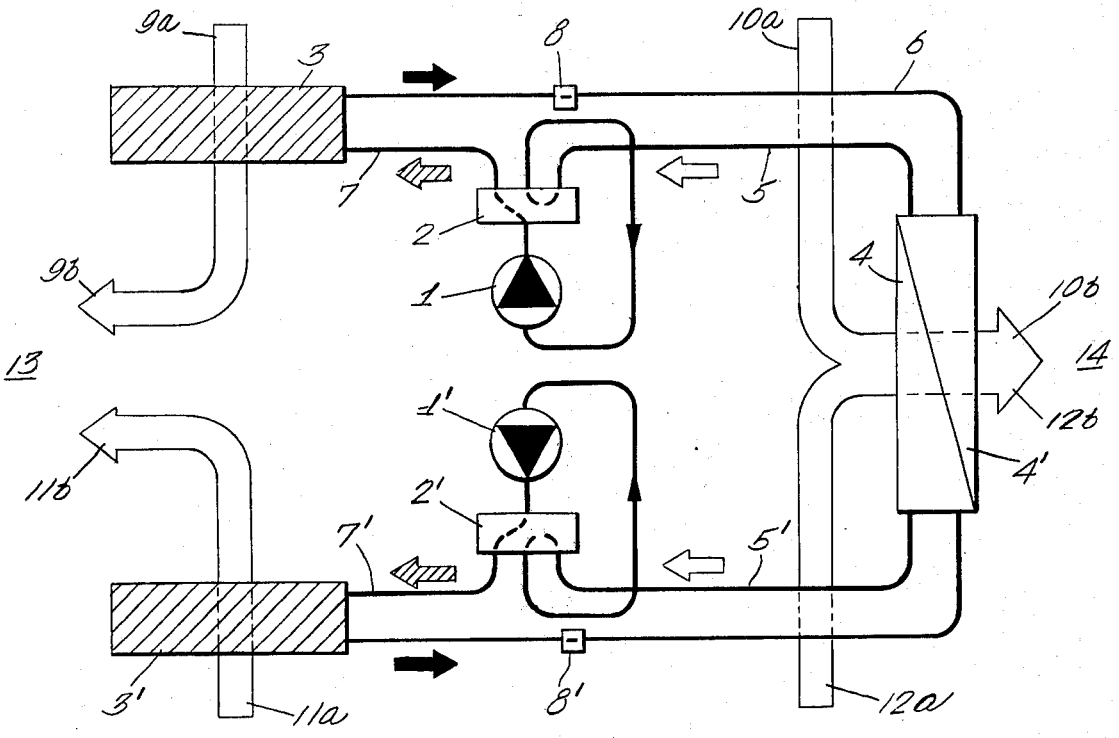
Figure 2:
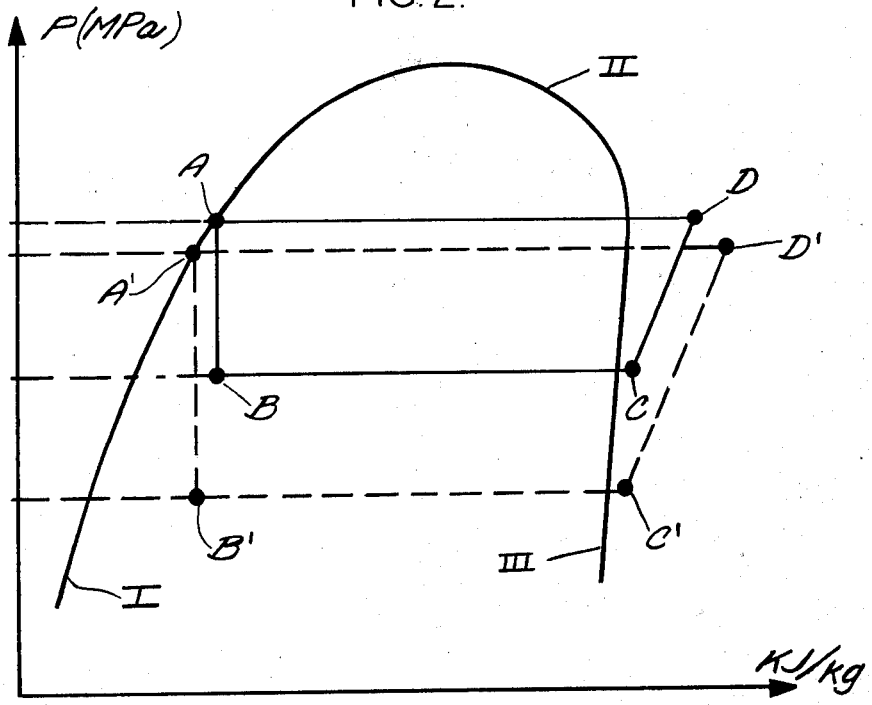
Figure 4:
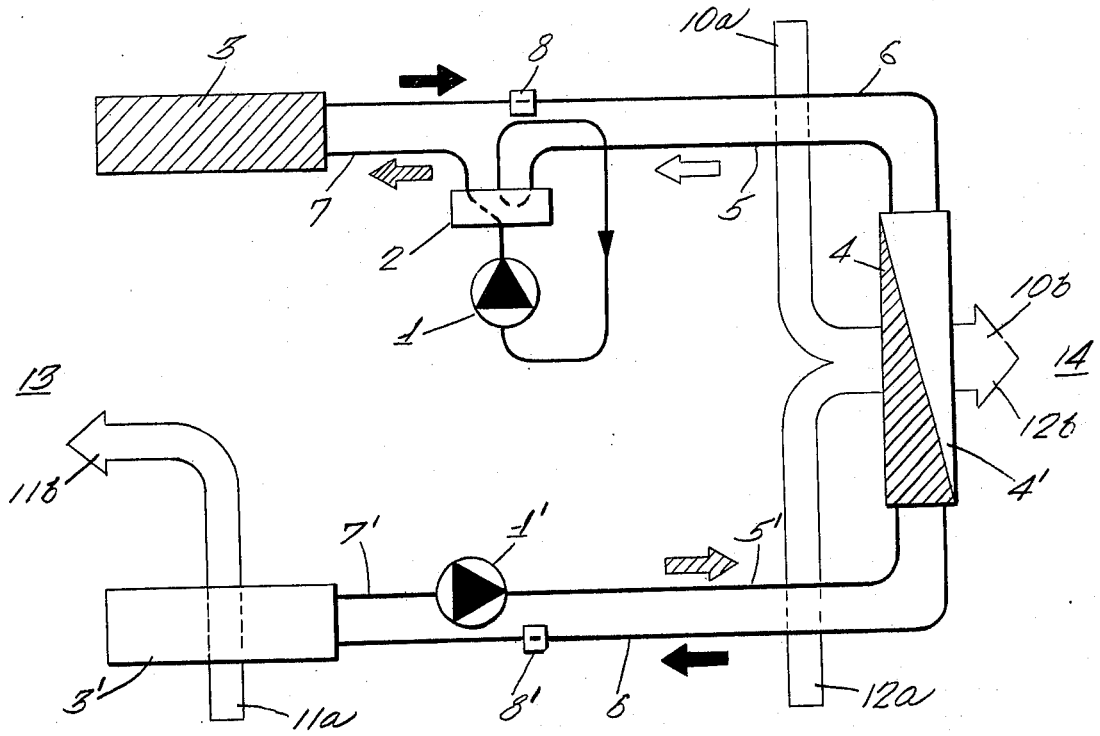
Figure 5:
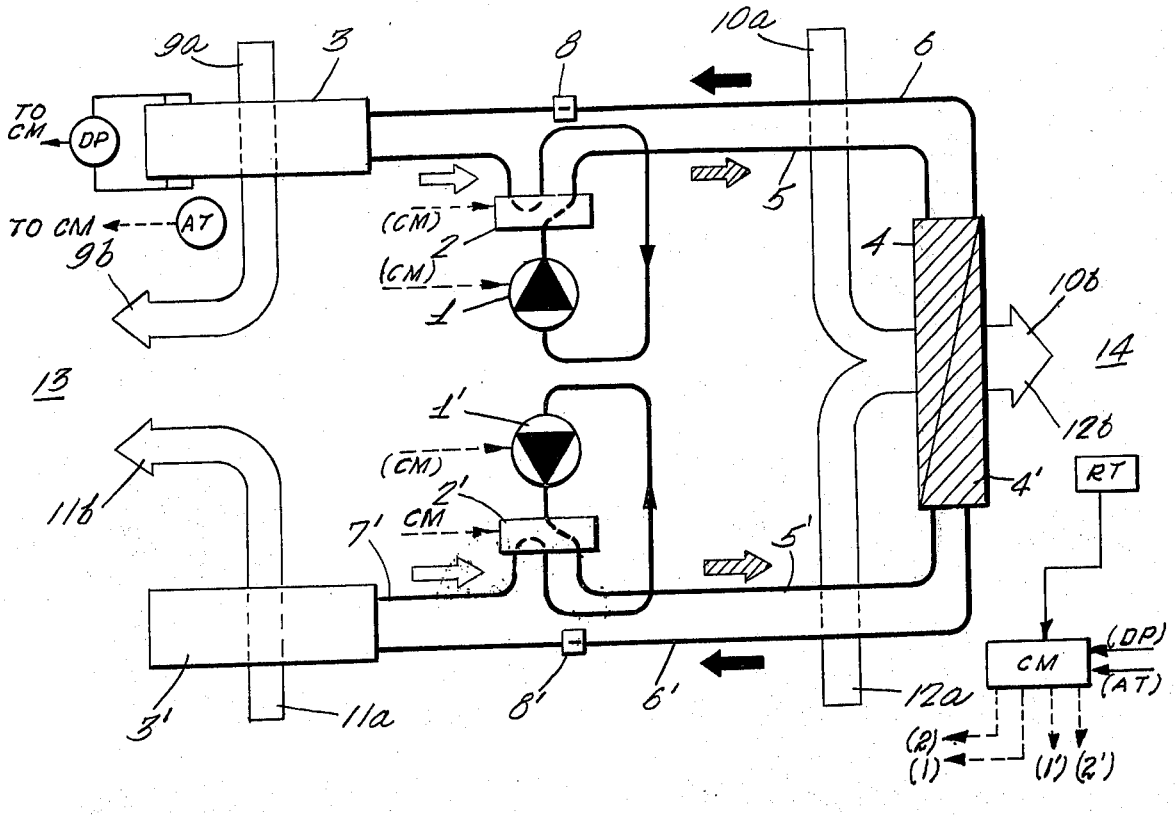

The invention is explained and described in greater detail in the following, with reference to the accompanying drawings, in which FIG. 1 is a schematic diagram, illustrating the function of the arrangement and of the details comprised therein in the "winter" case, i.e. for heating, FIG. 2 is a graph plotting the pressure as a function of the enthalpy and showing in full line the mode of operation of the base heat pump and in dashed line the mode of operation of the auxiliary heat pump comprised in the arrangement, FIG. 3 is a schematic diagram showing the arrangement switched to effect defrosting of the auxiliary heat pump, FIG. 4 is a schematic diagram showing the arrangement in which the condenser of the base heat pump is used to accelerate defrosting of the auxiliary heat pump, FIG. 5 is a schematic diagram showing the arrangement in a case in which the auxiliary heat pump and the base heat pump are both equipped with 4-way valves which can be switched to the position to effect cooling in the "summer" case, and FIG. 6 is a schematic diagram in which both of the 4-way valves are switched to the position for effecting cooling by means of both the base heat pump and the auxiliary heat pump.

As appears from the FIGS. 1, 3 and 4, the arrangement of the invention comprises two closed systems whereof the system shown in the lower part is a base heat pump and the system shown in the upper part is an auxiliary heat pump. In all Figures, hot details and lines transporting hot medium are indicated by sectioned arrows, cold details and lines transporting cold medium are indicated by unfilled arrows, and lines transporting liquid are indicated by filled arrows. Corresponding parts of the base and auxiliary pumps are designed by the same numerals, but with a prime mark in the case of the base heat pump. Corresponding parts in different figures are by the samenumerals.

In FIG. 1, the numerals 1 and 1' designate a compressor providing compressor means for each system, i.e. for both the base heat pump and for the auxiliary heat pump, and 2 designates a so-called four-way valve. 3, 4, 3' and 4' in FIG. 1 are heat exchangers, of which 3 and 3' are being used as evaporators and 4 and 4' are being used as condensers. 5 and 5' designate hot gas lines from the compressor 1 and 1' respectively to the condenser 4, and 4' and 6 and 6' are liquid line from the condensers 4 and 4' to the evaporators and 3'. Suction lines from said evaporators 3 and 3' to the compressors 1 and 1′ are designated by 7, and 7′ respectively and 8 and 8′ are throttle members in the liquid lines 6 and 6′ between the condenser 4 and 4′ and evaporators 3 and 3′ respectively. 9*a*–9*b* designate a separate outside air stream for the auxiliary heat pump, and 10*a*–10*b* designate outside air taken in for ventilation purposes. The arrow 11*a*–11*b* indicates an air stream taken out from the room and removed as spent or without air to the atmosphere. The arrow 12*a*–12*b* indicates that portion of the spent air of the room which is returned as return air to the room and together with the outside air stream 10*a*–10*b* constitutes the supply air 14 of the system. 13 designates the total of the air emitted to the atmosphere.

In FIG. 2, an exemplifying case of the closed working range for a base heat pump and, respectively, an auxiliary heat pump has been positioned in a pressure-enthalpy diagram. The axes represent in known manner the enthalpy in kilgouls per kilogram and, respectively, pressure values in megapascals during the run of the closed process. The lower limit curve I–II is the line only for liquid, and the upper limit curve II–III is the line only for dry saturated vapor. The area for moist vapor is defined by the two borderlines I–II and, respectively, II–III, and II is the so-called critical point. The working range of the base heat pump is designated A-B-C-D-A, and the corresponding working range for the auxiliary heat pump is designated A′-B′-C′-D′-A′. The distance A–B represeents the expansion of the medium (liquid) which takes place in the line 6′ in FIG. 1 when the throttle member is being passed. This part of the process, as shown, implies a pressure drop, which according to the invention, however, takes place only to such a level of condition as to prevent frost formation in the base heat pump. The distance B-14 C represents an evaporation with maintained pressure in the evaporator 3′ in FIG. 1. The medium next arrives at the compressor 1 where with temperature increase the compression takes place, which in the diagram is indicated by C–D. In the point D, and to the right of the borderline II–III, the medium now is in the state of superheated vapor. This vapor is utilized in the condenser 4′ for heating the outside air 10*a*–10*b* and the return air 12*a*–12*b*, which in heated state are supplied to the room(s) as supply air 14. The condensing of the medium in the condenser 4′, as a matter of fact, implies a transformation from the aggregate state vapor to liquid, at which transformation heat is released. Corresponding parts of the working process for the auxiliary heat pump are designated A′-B′, B′-C′, C′-D′ and, finally, D′-A′. The base heat pump according to the invention is designed to work within a limited temperature range where no frost formation takes place, but the auxiliary heat pump covers a wider working range.

Owing to the design of the arrangement as described above, the capacity of the base heat pump can be so dimensioned that the operation periods of the auxiliary heat pump are limited in wintertime to the climate periods when the temperature of the outside air is so low that its moisture content will be low, and consequently, the resulting frost cover be insignificant.

When the auxiliary heat pump according to FIG. 3 is being defrosted, the four-way valve 2 of said auxiliary heat pump has the opposite setting from that in FIG. 1, which shows the heating case. In opposition to the function of FIG. 1, in FIG. 3 heat is transmitted from the heat exchanger 4 of the auxiliary heat pump, said exchanger being located in the room supply air flow — which heat exchanger temporarily functions as evaporator — to the heat exchanger 3 of the auxiliary heat pump — which last mentioned heat exchanger thus temporarily functions as condenser — causing a defrosting of the heat exchanger 3. The battery 4 of the auxiliary heat pump mounted in the supply air flow 14 is disposed where the air temperature is lowest, i.e. ahead of heat exchanger 4 of the base heat pump. This will provide a compression ratio favourable for the compressor process, with moderate gas temperature and moderate stresses on the material As shown in FIG. 4, it is however possible instead of the above described arrangement to place the heat exchanger 4′ of the base heat pump located in the supply air flow before the heat exchanger 4 of the auxiliary heat pump disposed in the same air flow. Due to this, the heat required for defrosting the auxiliary heat pump will be taken from the condenser heat emanating from the base heat pump in order to accelerate the defrosting so that the defrosting periods are scarcely perceptible in the room(s).

In practice it may be convenient to provide also the base heat pump with a four-way valve 2′, which is illustrated in FIG. 5. For the rest, this figure shows the same type of arrangement as FIG. 1. Thanks to this equipment, the arrangement may also be utilized for cooling of the room(s) in summer time by the aid of one or both of the said heat pumps. When utilizing the arrangement for cooling in summer time, which is shown in FIG. 6, a reversing of the heat exchangers 3, 4, 3′, 4′ by means of the four-way valves 2, 2′ takes place in the respect that 3 and 3′ function as condensers and 4 and 4′ function as evaporators either in both the base heat pump and in the auxiliary heat pump branches or in one of them. By a switch-over of the four-way valve(s) the line 5 and 5′ function as suction lines between the evaporators 4 and 4′ and the compressors 1, and 1′ while the lines 7 and 7′ function as hot gas lines from the said compressors 1 and 1′ to the condensers now disposed respectively in the flow of in the base heat pump outdoor air in the base heat pump in the auxiliary heat pump branch at the top of the schematic figure and in the flow of outdoor air in the base heat pump at the bottom of the figure.

FIG. 5 also shows one possible general arrangement of control system, using conventional elements, for controlling the operation of the valves and compressors. The control module CM is supplied with electrical signals representing room temperature, from room thermostat RT; with electricalsignals representing the temperatures of auxiliary evaporator 3, from auxiliary thermostat AT; and with electrical signals representing the differential pressure across evaporator 3, from differential pressure sensor DP. Control module CM responds to these signals to control valves 2 and 2′ and compressors 1 and 1′ is required for the previously-described operation. That is, when RT shows full heat demand, the control module CM shifts both four-way valves to their "heating" positions, and places both compressors in operation; when RT shows low heat demand, CM stops the compressor 1 in the auxiliary heat pump; when neither nor cooling is demanded, CM stops both compressors; when there is a small cooling demand, CM shifts both valves 2 and 2′ to their "cooling" positions, and starts the auxiliary compressor 1; upon high cooling demand, CM causes both compressors to run, with the valves still in "cooling" position. In the winter, if frost should develop substantially on evaporator 3 of the auxiliary heat pump, differential pressure sensor DP senses when the frost build-up is so great that the efficiency of the evaporator is too low, and signals the control module CM to shift the auxiliary pump four-way valve 2 to its "heating" position, and preferably also stops the flow of outside air *9a–9b* over evaporator 3. The defrosting cycle is terminated when auxiliary thermostat AT signals CM that the temperature of evaporator 3 has risen to a point indicating removal of all frost, and CM responds to shift valve 2 back to its "heating" position. All elements and individual functions described being capable of provision by conventional known apparatus, no further discussion thereof is necessary.

I claim:

1. A heat pump system for heating a room having room-air exhaust means for delivering substantially only exhaust air from said room to the outside atmosphere, comprising:

base heat-pump means, comprising first heat exchanger means in heat-exchange relation with exhaust air in said room-air exhaust means, second heat exchanger means in heat-exchanger relation with air supplied to said room, first means for circulating a fluid medium between said first and second heat exchanger means, and first compressor means cooperating with said first circulating means and acting on said fluid medium for operating said first heat exchaner means as an evaporator to absorb heat from said exhaust air and for operating said second heat exchanger means as a condenser to deliver heat to said room;

auxiliary heat-pump means, comprising third heat exchanger means in heat-exchange relation with said outside atmosphere, fourth heat exchanger means in heat-exchange relation with said air supplied to said room, second means for circulating a fluid medium between said third and fourth heat exchanger means, and second compressor means cooperating with said second circulating means and acting on said fluid medium for operating said third heat exchanger means as an evaporator to absorb heat from said atmosphere and for operating said fourth heat exchanger means as a condenser to deliver heat to said room;

said evaporator of said base heat-pump means being positioned in relation to said room-air exhaust means so that said exhaust air adjacent said last-named evaporator remains above the freezing temperature of water in said air, even when the temperature of said outside atmosphere is substantially below said freezing temperature, whereby frosting of said last-named evaporator is prevented;

means for operating said base heat-pump means as demanded for maintaining the desired temperature of said room; and means for operating said auxiliary heat-pump means to effect additional heating of said room only when the temperature of said atmosphere becomes so low that said base heat-pump means is not able by itself to maintain said desired temperature.

2. The system of claim 1, comprising means for reversing the cycle of said auxiliary heat-pump means as desired to defrost said evaporator thereof.

3. The system of claim 2, comprising means for delivering heat from said condenser of said base heat-pump means to said evaporator of said auxiliary heat-pump means when defrosting thereof is desired.

4. The system of claim 3, wherein said condenser of said base heat-pump means is positioned in heat-exchange relation to said condenser of said auxiliary heat-pump means to effect said delivery of heat during said defrosting.

5. The system of claim 1, comprising means for reversing the cycles of both said base heat-pump means and said auxiliary heat-pump means to effect cooling of said room when same is desired.

6. The system of claim 1, wherein said room-air exhaust means comprises an exhaust-air duct and said evaporator portion of said first heat exchanger is positioned in said exhaust-air duct, said system also comprising an air supply duct for said room, said second and fourth heat exchanger means having their operative portions positioned within said room air supply duct.

7. The system of claim 1, wherein said condenser of said auxiliary heat-pump means is located in a cooler part of said system than said condenser of said base heat-pump means.

* * * * *

UNITED STATES PATENT OFFICE

CERTIFICATE OF CORRECTION

PATENT NO. : 3,995,809

DATED : December 7, 1976

INVENTOR(S) : Tord Herlog Ingemar Karlsson

It is certified that error appears in the above-identified patent and that said Letters Patent are hereby corrected as shown below:

Column 1, line 7, after "of" --a-- should be inserted.
Column 2, line 54, "designed" should read --designated--.
" line 57, after "are" --designated-- should be inserted
Column 2, line 67, after "evaporators" --3-- should be inserted.
Column 3, line 8, after "or" --exhaust-- should be inserted.

Column 3, line 17, "positioned" should be --presented--.
Column 4, line 8, "4" should be --4'--.
" lines 40-44 should read --disposed respectively in the flow of outdoor air in the auxiliary heat pump branch at the top of the schematic figure, and in the flow of outdoor air in the base heat pump at the bottom of the figure.--
Column 4, line 56, "is" should be --as--.

Column 4, line 62, after "neither" --heating-- should be in-

Column 5, line 23, "heat-exchanger" should read -- heat-exchange --.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*